US006112145A

United States Patent [19]

Zachman

[11] Patent Number: 6,112,145

[45] Date of Patent: Aug. 29, 2000

[54] METHOD AND APPARATUS FOR CONTROLLING THE SPATIAL ORIENTATION OF THE BLADE ON AN EARTHMOVING MACHINE

[75] Inventor: Mark Eugene Zachman, Troy, Ohio

[73] Assignee: Spectra Precision, Inc., Dayton, Ohio

[21] Appl. No.: 09/237,786

[22] Filed: Jan. 26, 1999

[51] Int. Cl.[7] ..... G06F 7/00; E02F 3/85

[52] U.S. Cl. ..... 701/50; 37/347; 37/348; 172/4.5; 172/9; 172/190; 172/818

[58] Field of Search ..... 701/50, 300; 37/347, 37/348; 172/4.5, 9, 190, 811, 818, 820

[56] References Cited

U.S. PATENT DOCUMENTS

| | | | |
|---|---|---|---|
| 3,786,871 | 1/1974 | Long et al. | 172/4.5 |
| 4,081,033 | 3/1978 | Bulger et al. | 172/4.5 |
| 4,431,060 | 2/1984 | Scholl et al. | 172/4.5 |
| 4,545,439 | 10/1985 | Sellett et al. | 172/430 |
| 4,926,948 | 5/1990 | Davidson et al. | 172/4.5 |
| 5,078,215 | 1/1992 | Nau | 172/4.5 |
| 5,107,932 | 4/1992 | Zachman et al. | 172/4.5 |
| 5,951,613 | 9/1999 | Sahm et al. | 701/50 |
| 5,964,298 | 10/1999 | Greenspun | 172/4.5 |

*Primary Examiner*—Jacques H. Louis-Jacques
*Assistant Examiner*—Yonel Beaulieu
*Attorney, Agent, or Firm*—Killworth, Gottman, Hagan & Schaeff, LLP

[57] ABSTRACT

A blade control system is configured to control the spatial orientation of an earthmoving blade mounted on a frame of an earthmoving machine for working a surface of earth to a desired shape. The blade slope angle required to maintain a selected cross-slope angle is calculated and the blade slope is then controlled so that the sensed blade slope angle is substantially equal to the calculated blade slope angle. The method and apparatus of the present invention is capable of maintaining the desired cross-slope even when the motor-grader is steered through a turn. The control system includes an input circuit, a sensor system and a processor. The input circuit is arranged to generate an output signal representative of the desired shape of the surface of earth to be worked. The sensor system includes a first sensor coupled to the frame of the earthmoving machine to generate a first signal indicative of a longitudinal slope angle of the frame with respect to horizontal. The sensor system also includes a second sensor coupled to the frame to generate a second signal indicative of a turn angle of the frame relative to a direction of travel of the blade. The processor is electrically coupled to the input circuit and the sensor system and is programmed to control the spatial orientation of the blade in response to at least the output signal from the input circuit, the first signal from the first sensor and the second signal from said second sensor so as to maintain the selected cross-slope angle.

66 Claims, 4 Drawing Sheets

METHOD AND APPARATUS FOR CONTROLLING THE SPATIAL ORIENTATION OF THE BLADE ON AN EARTHMOVING MACHINE

BACKGROUND OF THE INVENTION

The present invention relates in general to a control system for controlling a blade carried by a motorgrader used for earthworking, and, more particularly, to a method and apparatus for controlling the spatial orientation of the blade of an earthmoving machine while shaping a surface of earth and, even more particularly, to a method and apparatus for controlling the cross-slope angle cut by a motorgrader while the motorgrader is making a turn.

Earthmoving machines for shaping the surface of the ground at a construction site typically include a frame mounting some form of an earthmoving or cutting blade. When preparing the subsurface of, for example, a highway, an airport runway, a parking lot and the like, it is typically desirable for the contour or grade of the subsurface shaped by the blade to approximate the finished surface as closely as possible. How accurately the surface of the ground is shaped depends upon how accurately the spatial orientation of the earthmoving blade can be determined and maintained and how accurately the direction of travel of the blade can be determined. The blade of some earthmoving machines are more difficult to accurately control than others.

For example, a typical motorgrader has a two-part articulated frame, defined by a rear drive unit and a front steering unit, and a cutting blade mounted on the front steering unit. The articulated frame allows the front steering unit to be rotated or pivoted relative to the drive unit. For example, the motorgrader is said to be in a "crabbed" steering position when it is operated in an articulated position and traveling in the direction defined by and in-line with its rear drive unit. It is often desirable to operate a motorgrader with its front steering unit articulated at an angle relative to its rear drive unit, for example, to position the drive unit on firm ground. As another example, the motorgrader is said to be steering through a turn when the front wheels on the steering unit are turned either to the right or left and the rear drive unit is either straight or turned to the same side as the front wheels. It is also desirable to cut a grade with a motorgrader while steering through a turn as would be the case in building a clover leaf on a ramp or a cul-de-sac. A motorgrader cutting blade is usually mounted on its steering unit so as to be adjustably moveable, including one or more being rotated about a central vertical axis, pitched forward or backward, rolled (i.e., banked) or side-shifted to the left or right and vertically raised or lowered.

The slope of a motorgrader blade is usually one element of the blade's spatial configuration that is controlled during the surface shaping process. By monitoring the direction of travel of the blade and monitoring its slope, the surface of the earth can be formed to a predetermined cross-slope. The definition of slope is the slant of a surface relative to horizontal. Cross-slope is defined as the slope of a surface perpendicular to the direction of travel. When a motorgrader is operated in a turning mode, the actual direction of travel of the blade is different than any other structural member of the blade. This fact combined with the ability of the frame to articulate and/or the blade circle to side-shift, can compound the already difficult task of accurately controlling the cross-slope of the cutting blade.

A number of systems have been used to control the spatial orientation (e.g., the azimuth, pitch, roll and/or elevation) of an earthmoving blade, including the cutting blade of a motorgrader. However, many of these control systems are relatively inaccurate, particularly when the machine frame mounting the blade is articulated, as often occurs in operating a motorgrader. There are more accurate control systems than these, but they are relatively complex and expensive. And, even these more accurate control systems are unable to maintain a high degree of accuracy when the machine is turning or the circle is side-shifted, because they have no way of sensing that these events are occurring. If there is no compensation for the rotational effects of turning or side-shifting then errors are introduced into the control system.

Accordingly, there is a need for a relatively simple and inexpensive system for more accurately controlling the spatial orientation (e.g., the azimuth, pitch, roll and/or elevation) of an earthmoving blade and, thereby, more accurately control the shaping of a surface of the ground at a work site. More particularly, there is a need for a relatively simple and inexpensive way to determine the direction of travel and orientation of an earthmoving blade relative to gravity and independent of the balance of the earthmoving machine to thereby control the shaping of a requested slope or cross-slope cut in the ground, even while the motorgrader is turning, the blade is rotated or side-shifted, the frame is articulated, or the front wheels are tilted.

SUMMARY OF THE INVENTION

The present invention meets the aforementioned needs by providing a blade control system and method for controlling part of or the entire spatial orientation of an earthmoving blade working a surface of earth to a desired shape. The blade slope angle required to maintain a selected cross-slope angle is calculated and the blade slope is then controlled so that the sensed blade slope angle is substantially equal to the calculated blade slope angle. The method and apparatus of the present invention is capable of maintaining the desired cross-slope even when the motorgrader is steered through a turn.

According to a first aspect of the present invention, a control system for controlling the spatial orientation of an earthmoving blade mounted on a frame of an earthmoving machine and adjustably moveable by a blade actuating mechanism in order to control the working of a surface of earth to a desired shape is provided. The control system comprises an input circuit, a sensor system and a processor electrically coupled to the input circuit and the sensor system. The input circuit is arranged to generate an output signal representative of the desired shape of the surface of earth to be worked. The sensor system comprises a first sensor generating a first signal indicative of a longitudinal slope angle of the frame with respect to horizontal and a second sensor generating a second signal indicative of a turn angle between the frame and a direction of travel of the blade. The processor is programmed to control the spatial orientation of the blade by controlling the activation of the blade actuating mechanism in response to at least the output signal from the input circuit, the first signal from the first sensor and the second signal from the second sensor.

The first sensor may comprise a gyroscope or a gravity sensor, such as a slope sensor, an inclinometer, an accelerometer or a pendulum sensor. In addition to a gravity sensor, the first sensor may also comprise a rate sensor. The rate sensor may comprise a piezoelectric rate sensor or a ring laser. The second sensor may comprise a gyroscope, a rate sensor or a heading sensor.

The sensor system may further comprise a third sensor generating a third signal indicative of a rotational angle of the blade with respect to an axis perpendicular to the frame or an axis perpendicular to a blade frame supporting the blade with the processor being further programmed to control the spatial orientation of the blade by controlling the activation of the blade actuating mechanism in response to at least the output signal from the input circuit, the first signal from the first sensor, the second signal from the second sensor and the third signal from the third sensor. The sensor system may further comprise a fourth sensor generating a fourth signal indicative of a side-shift angle of the blade with respect to the frame with the processor being programmed to control the spatial orientation of the blade by controlling the activation of the blade actuating mechanism in response to at least the output signal from the input circuit, the first signal from the first sensor, the second signal from the second sensor and the fourth signal from the fourth sensor. The sensor system may further comprise a fifth sensor generating a fifth signal indicative of a lateral slope angle of the frame with respect to horizontal with the processor being programmed to control the spatial orientation of the blade by controlling the activation of the blade actuating mechanism in response to at least the output signal from the input circuit, the first signal from the first sensor, the second signal from the second sensor and the fifth signal from the fifth sensor. The fifth sensor may be a gravity sensor, such as a slope sensor, an inclinometer, an accelerometer or a pendulum sensor.

The sensor system may further comprise an elevation sensor arranged to determine a vertical position of the blade relative to the surface of earth being worked. The sensor system may further comprise a blade locating system for identifying a location of the blade on a work site. The blade locating system may comprise a Global Positioning System (GPS) with at least one GPS antenna mounted on the blade for identifying the location of the blade on the work site.

The input circuit is used to select a desired cross-slope angle of the surface of earth to be worked by the blade with the control system controlling the spatial orientation of the earthmoving blade to obtain the desired cross-slope angle of the surface as the surface is being worked. The processor may be programmed to calculate a blade slope angle used to obtain the desired cross-slope angle of the surface according to the following equations based on the signals from the first and second sensors:

$$\tan(BS)=\tan(CS)\cdot\cos(B)-\tan(R)\cdot\sin(B);\text{ and}$$

$$\tan(R)=\tan(M)\cdot\cos(B)-\tan(CS)\cdot\sin(B)$$

where BS is the blade slope angle of the blade relative to horizontal, CS is the desired cross-slope angle of the surface, B is the turn angle between the frame and the direction of travel of the blade, R is an angle between the direction of travel of the blade and horizontal, and M is the longitudinal slope angle of the frame with respect to horizontal.

In another aspect of the present invention, the processor may be programmed to calculate a blade slope angle used to obtain the desired cross-slope angle of the surface according to the following equations based on the signals from the first, second and fifth sensors:

$$\tan(BS)=\tan(CS)\cdot\cos(B)-\tan(R)\cdot\sin(B);\text{ and}$$

$$\tan(R)=\tan(M)\cdot\cos(B)-\tan(L)\cdot\sin(B)$$

where BS is the blade slope angle of the blade relative to horizontal, CS is the desired cross-slope angle of the surface, B is the turn angle between the frame and the direction of travel of the blade, R is an angle between the direction of travel of the blade and horizontal, M is the longitudinal slope angle of the frame with respect to horizontal, and L is the lateral slope angle of the frame with respect to horizontal.

According to another aspect of the present invention, a control system for controlling the spatial orientation of an earthmoving blade mounted on a frame of an earthmoving machine and adjustably moveable by a blade actuating mechanism in order to control the working of a surface of earth to a desired shape is provided. The control system comprises an input circuit, a sensor system and a processor electrically coupled to the input circuit and the sensor system. The input circuit is arranged to generate an output signal representative of the desired shape of the surface of earth to be worked. The sensor system comprises a first sensor generating a first signal indicative of a longitudinal slope angle of the frame with respect to horizontal, a second sensor generating a second signal indicative of a turn angle between the frame and a direction of travel of the blade, a third sensor generating a third signal indicative of a rotational angle of the blade, and a fourth sensor generating a fourth signal indicative of a side-shift angle of the blade with respect to the frame. The processor is programmed to control the spatial orientation of the blade by controlling the activation of the blade actuating mechanism in response to at least the output signal from the input circuit, the first signal from the first sensor, the second signal from the second sensor, the third signal from the third sensor and the fourth signal from the fourth sensor.

The input circuit is used to select a desired cross-slope angle of the surface of earth to be worked by the blade with the control system controlling the spatial orientation of the earthmoving blade to obtain the desired cross-slope angle of the surface as the surface is worked. The processor may be programmed to calculate a blade slope angle used to obtain the desired cross-slope angle of the surface according to the following equations based on the signals from the first, second, third and fourth sensors:

$$\tan(BS)=\tan(CS)\cdot\cos(T)+\tan(R)\cdot\sin(T);$$

$$\tan(R)=\tan(M)\cdot\cos(B)-\tan(CS)\cdot\sin(B);\text{ and}$$

$$T=\Theta+\sigma-B$$

where BS is the blade slope angle of the blade relative to horizontal, CS is the desired cross-slope angle of the surface, T is the rotational angle of the blade relative to the direction of travel of the blade, R is an angle between the direction of travel of the blade and horizontal, M is the longitudinal slope angle of the frame with respect to horizontal, $\Theta$ is the rotational angle of the blade, $\sigma$ is the side-shift angle of the blade with respect to the frame, and B is the turn angle between the frame and the direction of travel of the blade.

The sensor system may further comprise a fifth sensor generating a fifth signal indicative of a lateral slope angle of the frame with respect to horizontal with the processor being programmed to control the spatial orientation of the blade by controlling the activation of the blade actuating mechanism in response to at least the output signal from the input circuit, the first signal from the first sensor, the second signal from the second sensor, the third signal from the third sensor, the fourth signal from the fourth sensor and the fifth signal from the fifth sensor. The processor may be programmed to calculate a blade slope angle used to obtain the desired cross-slope angle of the surface according to the following equations based on the signals from the first, second, third, fourth and fifth sensors:

$$\tan(BS)=\tan(CS)\cdot\cos(T)+\tan(R)\cdot\sin(T);$$

$$\tan(R)=\tan(M)\cdot\cos(B)-\tan(L)\cdot\sin(B);\text{ and}$$

$$T=\Theta+\sigma-B$$

where BS is the blade slope angle of the blade relative to horizontal, CS is the desired cross-slope angle of the surface, T is the rotational angle of the blade relative to the direction of travel of the blade, R is an angle between the direction of travel of the blade and horizontal, M is the longitudinal slope angle of the frame with respect to horizontal, Θ is the rotational angle of the blade, σ is the side-shift angle of the blade with respect to the frame, B is the turn angle between the frame and the direction of travel of the blade, and L is the lateral slope angle of the frame with respect to horizontal.

The first sensor may comprise a gyroscope or a gravity sensor, such as a slope sensor, an inclinometer, an accelerometer or a pendulum sensor. The second sensor may comprise a gyroscope, a rate sensor or a heading sensor. The third sensor may comprise an encoder or a resistive potentiometer. The fourth sensor may comprise a gyroscope, a rate sensor or a heading sensor. The fifth sensor may comprise a gravity sensor, such as a slope sensor, an inclinometer, an accelerometer or a pendulum sensor.

According to yet another aspect of the present invention, an earthmoving machine comprises a vehicle having a frame, an earthmoving blade coupled to the frame and adjustably moveable with respect to the frame by a blade actuating mechanism, and a control system arranged to control a spatial orientation of the blade in order to control the working of a surface of earth to a desired shape. The control system comprises an input circuit arranged to generate an output signal representative of the desired shape of the surface of earth to be worked, a sensor system and a processor electrically coupled to the input circuit and the sensor system. The sensor system comprises a first sensor generating a first signal indicative of a longitudinal slope angle of the frame with respect to horizontal and a second sensor generating a second signal indicative of a turn angle between the frame and a direction of travel of the blade. The processor is programmed to control the spatial orientation of the blade by controlling the activation of the blade actuating mechanism in response to at least the output signal from the input circuit, the first signal from the first sensor and the second signal from the second sensor.

The earthmoving machine may further comprise a blade frame coupled to the frame of the vehicle with the blade being coupled to the blade frame. The sensor system comprises a third sensor generating a third signal indicative of a rotational angle of the blade with the processor being programmed to control the spatial orientation of the blade by controlling the activation of the blade actuating mechanism in response to at least the output signal from the input circuit, the first signal from the first sensor, the second signal from the second sensor and the third signal from the third sensor. The sensor system may further comprise a fourth sensor generating a fourth signal indicative of a side-shift angle of the blade with respect to the frame with the processor being programmed to control the spatial orientation of the blade by controlling the activation of the blade actuating mechanism in response to at least the output signal from the input circuit, the first signal from the first sensor, the second signal from the second sensor, the third signal from the third sensor and the fourth signal from the fourth sensor. The sensor system may further comprise a fifth sensor generating a fifth signal indicative of a lateral slope angle of the frame with respect to horizontal with the processor being programmed to control the spatial orientation of the blade by controlling the activation of the blade actuating mechanism in response to at least the output signal from the input circuit, the first signal from the first sensor, the second signal from the second sensor, the third signal from the third sensor, the fourth signal from the fourth sensor and the fifth signal from the fifth sensor.

The input circuit is used to select a desired cross-slope angle of the surface of earth to be worked by the blade with the control system controlling the spatial orientation of the earthmoving blade to obtain the desired cross-slope angle of the surface as the surface is being worked. The processor may be programmed to calculate a blade slope angle used to obtain the desired cross-slope angle of the surface according to the following equations based on the signals from the first and second sensors:

$$\tan(BS)=\tan(CS)\cdot\cos(B)-\tan(R)\cdot\sin(B);\text{ and}$$

$$\tan(R)=\tan(M)\cdot\cos(B)-\tan(CS)\cdot\sin(B)$$

where BS is the blade slope angle of the blade relative to horizontal, CS is the desired cross-slope angle of the surface, B is the turn angle between the frame and the direction of travel of the blade, R is an angle between the direction of travel of the blade and horizontal, and M is the longitudinal slope angle of the frame with respect to horizontal.

In another aspect of the present invention, the processor may be programmed to calculate a blade slope angle used to obtain the desired cross-slope angle of the surface according to the following equations based on the signals from the first, second and fifth sensors:

$$\tan(BS)=\tan(CS)\cdot\cos(B)-\tan(R)\cdot\sin(B);\text{ and}$$

$$\tan(R)=\tan(M)\cdot\cos(B)-\tan(L)\cdot\sin(B)$$

where BS is the blade slope angle of the blade relative to horizontal, CS is the desired cross-slope angle of the surface, B is the turn angle between the frame and the direction of travel of the blade, R is an angle between the direction of travel of the blade and horizontal, M is the longitudinal slope angle of the frame with respect to horizontal, and L is the lateral slope angle of the frame with respect to horizontal.

In yet another aspect of the present invention, the processor may be programmed to calculate a blade slope angle used to obtain the desired cross-slope angle of the surface according to the following equations based on the signals from the first, second, third and fourth sensors:

$$\tan(BS)=\tan(CS)\cdot\cos(T)+\tan(R)\cdot\sin(T);$$

$$\tan(R)=\tan(M)\cdot\cos(B)-\tan(CS)\cdot\sin(B);\text{ and}$$

$$T=\Theta+\sigma-B$$

where BS is the blade slope angle of the blade relative to horizontal, CS is the desired cross-slope angle of the surface, T is the rotational angle of the blade relative to the direction of travel of the blade, R is an angle between the direction of travel of the blade and horizontal, M is the longitudinal slope angle of the frame with respect to horizontal, Θ is the rotational angle of the blade, σ is the side-shift angle of the blade with respect to the frame, and B is the turn angle between the frame and the direction of travel of the blade.

In a further aspect of the present invention, the processor may be programmed to calculate a blade slope angle used to obtain the desired cross-slope angle of the surface according to the following equations based on the signals from the first, second, third, fourth and fifth sensors:

$$\tan(BS)=\tan(CS)\cdot\cos(T)+\tan(R)\cdot\sin(T);$$

$$\tan(R)=\tan(M)\cdot\cos(B)-\tan(L)\cdot\sin(B);\text{ and}$$

$$T=\Theta+\sigma-B$$

where BS is the blade slope angle of the blade relative to horizontal, CS is the desired cross-slope angle of the surface, T is the rotational angle of the blade relative to the direction of travel of the blade, R is an angle between the direction of travel of the blade and horizontal, M is the longitudinal slope angle of the frame with respect to horizontal, $\Theta$ is the rotational angle of the blade, $\sigma$ is the side-shift angle of the blade with respect to the frame, B is the turn angle between the frame and the direction of travel of the blade, and L is the lateral slope angle of the frame with respect to horizontal.

The first sensor may comprise a gyroscope or a gravity sensor, such as a slope sensor, an inclinometer, an accelerometer or a pendulum sensor. The second sensor may comprise a gyroscope, a rate sensor or a heading sensor. The third sensor may comprise an encoder or a resistive potentiometer. The fourth sensor may comprise a gyroscope, a rate sensor or a heading sensor. The fifth sensor may comprise a gravity sensor, such as a slope sensor, an inclinometer, an accelerometer or a pendulum sensor.

The sensor system may further comprise an elevation sensor arranged to determine a vertical position of the blade relative to the surface of earth being worked. The sensor system may further comprise a blade locating system for identifying a location of the blade on a work site. Preferably, the blade locating system comprises a Global Positioning System (GPS) with at least one GPS antenna mounted on the blade for identifying the location of the blade on the work site. The vehicle may comprise a bulldozer or a motorgrader.

According to further aspect of the present invention, a method of working a surface of earth to a desired shape is provided. A frame coupled to an adjustably moveable earthmoving blade for working the surface of earth to the desired shape is provided. The surface of earth is worked to the desired shape with the earthmoving blade. A change in a longitudinal slope of the frame with respect to horizontal is detected as the earthmoving blade works the surface of earth. A change in a turn angle between the frame and a direction of travel of the earthmoving blade is detected as the earthmoving blade works the surface of earth. A spatial orientation of the earthmoving blade is controlled so as to control the working of the surface of earth to the desired shape, at least in part, in response to the detected changes in the longitudinal slope and the turn angle.

The method may further comprise the step of detecting a change in a rotational angle of the blade as the earthmoving blade works the surface of earth with detected changes in the longitudinal slope of the frame, the turn angle and the rotational angle of blade being used to control the spatial orientation of the earthmoving blade so as to control the working of the surface of earth to the desired shape. The method may further comprise the step of detecting a change in a side-shift angle of the blade relative to the frame with detected changes in the longitudinal slope of the frame, the turn angle, the rotational angle of blade and the side-shift angle of blade being used to control the spatial orientation of the earthmoving blade so as to control the working of the surface of earth to the desired shape. The method may further comprise the step of detecting a change in a lateral slope angle of the frame relative to horizontal with detected changes in the longitudinal slope of the frame, the turn angle, the rotational angle of blade, the side-shift angle of blade and the lateral slope angle of frame being used to control the spatial orientation of the earthmoving blade so as to control the working of the surface of earth to the desired shape.

The method may further comprise the step of locating a vertical position of the earthmoving blade relative to the surface of earth being worked. The method may further comprise the step of identifying a location of the earthmoving blade on a work site containing the surface of earth being worked. The method may further comprise the step of selecting a desired cross-slope angle of the surface of earth to be worked. The step of controlling a spatial orientation of the earthmoving blade is for controlling the working of the surface of earth to a desired cross-slope angle, at least in part, in response to the detected changes in the longitudinal slope and the turn angle, and includes the step of calculating a blade slope angle used to obtain the desired cross-slope angle of the surface according to the following equations:

$$\tan(BS)=\tan(CS)\cdot\cos(B)-\tan(R)\cdot\sin(B);\text{ and}$$

$$\tan(R)=\tan(M)\cdot\cos(B)-\tan(CS)\cdot\sin(B)$$

where BS is the blade slope angle of the blade relative to horizontal, CS is the desired cross-slope angle of the surface, B is the turn angle between the frame and the direction of travel of the blade, R is an angle between the direction of travel of the blade and horizontal, and M is the longitudinal slope angle of the frame with respect to horizontal.

In another aspect of the present invention, the step of controlling a spatial orientation of the earthmoving blade is for controlling the working of the surface of earth to a desired cross-slope angle, at least in part, in response to the detected changes in the longitudinal slope, the turn angle, the rotational angle and the side-shift angle, and includes the step of calculating a blade slope angle used to obtain the desired cross-slope angle of the surface according to the following equations:

$$\tan(BS)=\tan(CS)\cdot\cos(T)+\tan(R)\cdot\sin(T);$$

$$\tan(R)=\tan(M)\cdot\cos(B)-\tan(CS)\cdot\sin(B);\text{ and}$$

$$T=\Theta+\sigma-B$$

where BS is the blade slope angle of the blade relative to horizontal, CS is the desired cross-slope angle of the surface, T is the rotational angle of the blade relative to the direction of travel of the blade, R is an angle between the direction of travel of the blade and horizontal, M is the longitudinal slope angle of the frame with respect to horizontal, $\Theta$ is the rotational angle of the blade, $\sigma$ is the side-shift angle of the blade with respect to the frame, and B is the turn angle between the frame and the direction of travel of the blade.

In a yet another aspect of the present invention, the step of controlling a spatial orientation of the earthmoving blade is for controlling the working of the surface of earth to a desired cross-slope angle, at least in part, in response to the detected changes in the longitudinal slope, the turn angle, the rotational angle, the side-shift angle, and the lateral slope, and includes the step of calculating a blade slope angle used to obtain the desired cross-slope angle of the surface according to the following equations:

$$\tan(BS)=\tan(CS)\cdot\cos(T)+\tan(R)\cdot\sin(T);$$

$$\tan(R)=\tan(M)\cdot\cos(B)-\tan(L)\cdot\sin(B);\text{ and}$$

$$T=\Theta+\sigma-B$$

where BS is the blade slope angle of the blade relative to horizontal, CS is the desired cross-slope angle of the surface, T is the rotational angle of the blade relative to the direction of travel of the blade, R is an angle between the direction of travel of the blade and horizontal, M is the longitudinal slope angle of the frame with respect to horizontal, $\Theta$ is the rotational angle of the blade, $\sigma$ is the side-shift angle of the blade with respect to the frame, B is the turn angle between the frame and the direction of travel of the blade, and L is the lateral slope angle of the frame with respect to horizontal.

In a further aspect of the present invention, the step of controlling a spatial orientation of the earthmoving blade is for controlling the working of the surface of earth to a desired cross-slope angle, at least in part, in response to the detected changes in the longitudinal slope, the turn angle, and the lateral slope, and includes the step of calculating a blade slope angle used to obtain the desired cross-slope angle of the surface according to the following equations:

$$\tan(BS)=\tan(CS)\cdot\cos(B)-\tan(R)\cdot\sin(B);\text{ and}$$

$$\tan(R)=\tan(M)\cdot\cos(B)-\tan(L)\cdot\sin(B)$$

where BS is the blade slope angle of the blade relative to horizontal, CS is the desired cross-slope angle of the surface, B is the turn angle between the frame and the direction of travel of the blade, R is an angle between the direction of travel of the blade and horizontal, M is the longitudinal slope angle of the frame with respect to horizontal, and L is the lateral slope angle of the frame with respect to horizontal.

The present control system is particularly described herein with regard to working a surface of earth with a motorgrader, for example, to a desired cross-slope angle. However, this is for exemplary purposes only, and the present invention is not intended to be so limited. The present control system may be used in any suitable earthmoving machine or method to manually or automatically control the spatial orientation of its earthmoving blade.

The objectives, features, and advantages of the present invention will become apparent upon consideration of the present specification and the appended drawings.

DETAILED DESCRIPTION OF THE INVENTION

Although the present invention is herein described in terms of the illustrated embodiment, it will be readily apparent to those skilled in this art that various modifications, re-arrangements, and substitutions can be made without departing from the spirit of the invention. For the purposes of example only, the present invention is herein described with regard to controlling the cutting blade of a motorgrader. Even so, the present invention is not intended to be so limited. It is understood that the principles may be applicable to controlling the earthmoving blade of other types of earthmoving machines. For example, the present inertial reference based control system may be used in any suitable earthmoving machine or method to manually or automatically control the spatial orientation of its earthmoving blade. Accordingly, the scope of the present invention is only limited by the claims appended hereto.

Figure 3:
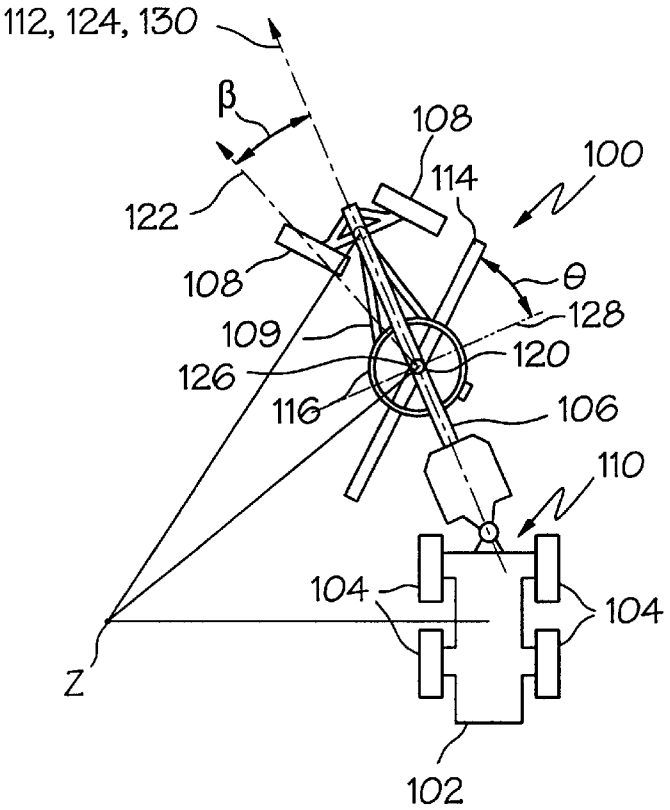
FIG. 3 is a schematic plan view of the articulated motorgrader of FIG. 1 being steered through a turn.
Figure 2:
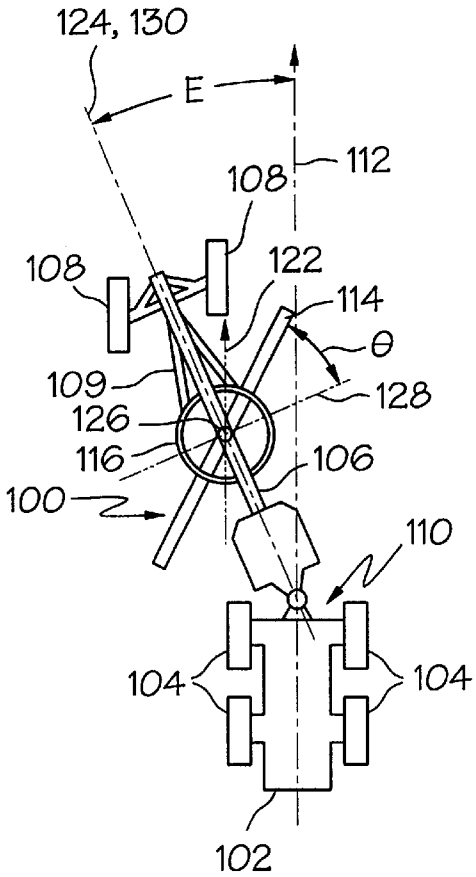
FIG. 2 is a schematic plan view of the articulated motorgrader of FIG. 1 illustrating articulated frame operation or "crabbed" steering operation.
Figure 1:
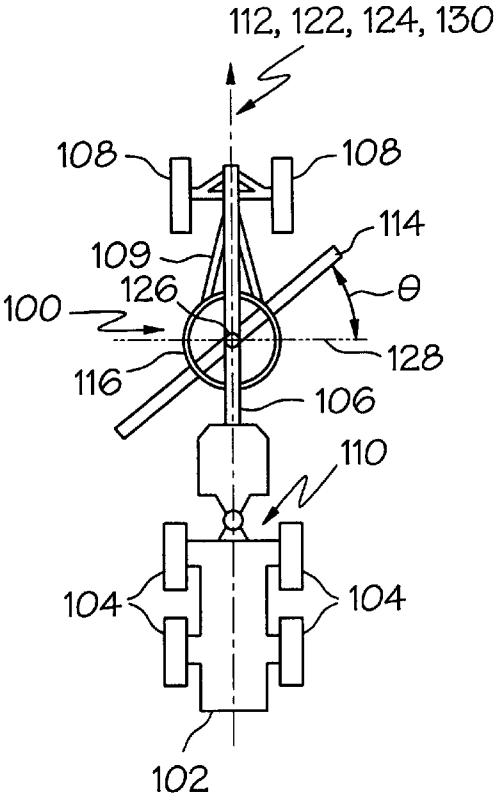
FIG. 1 is a schematic plan view of an articulated frame motorgrader illustrating straight frame operation.
Figure 4:
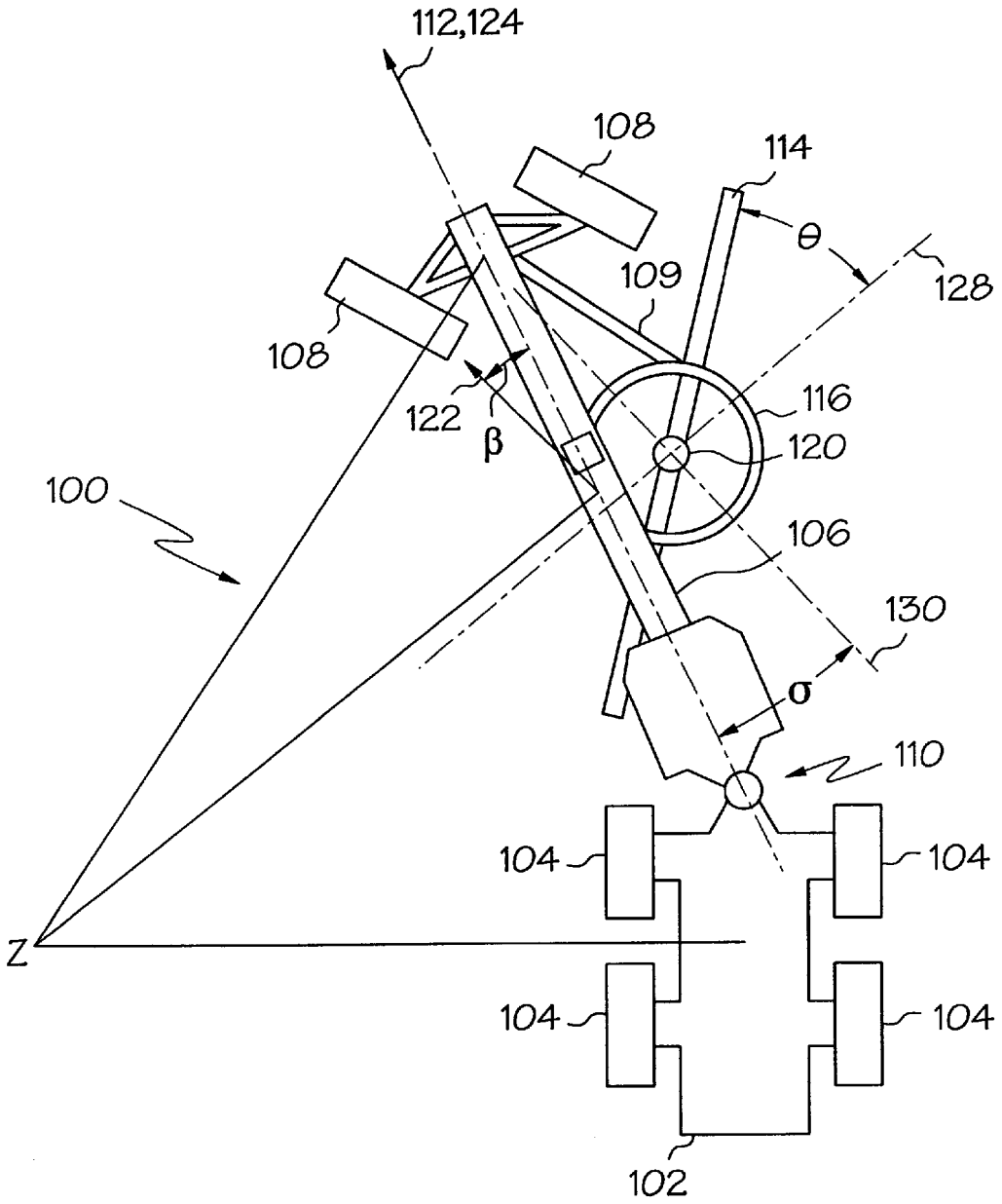
FIG. 4 is a schematic plan view of the articulated motorgrader of FIG. 1. being steered through a turn with the blade side-shifted.
Figure 5:
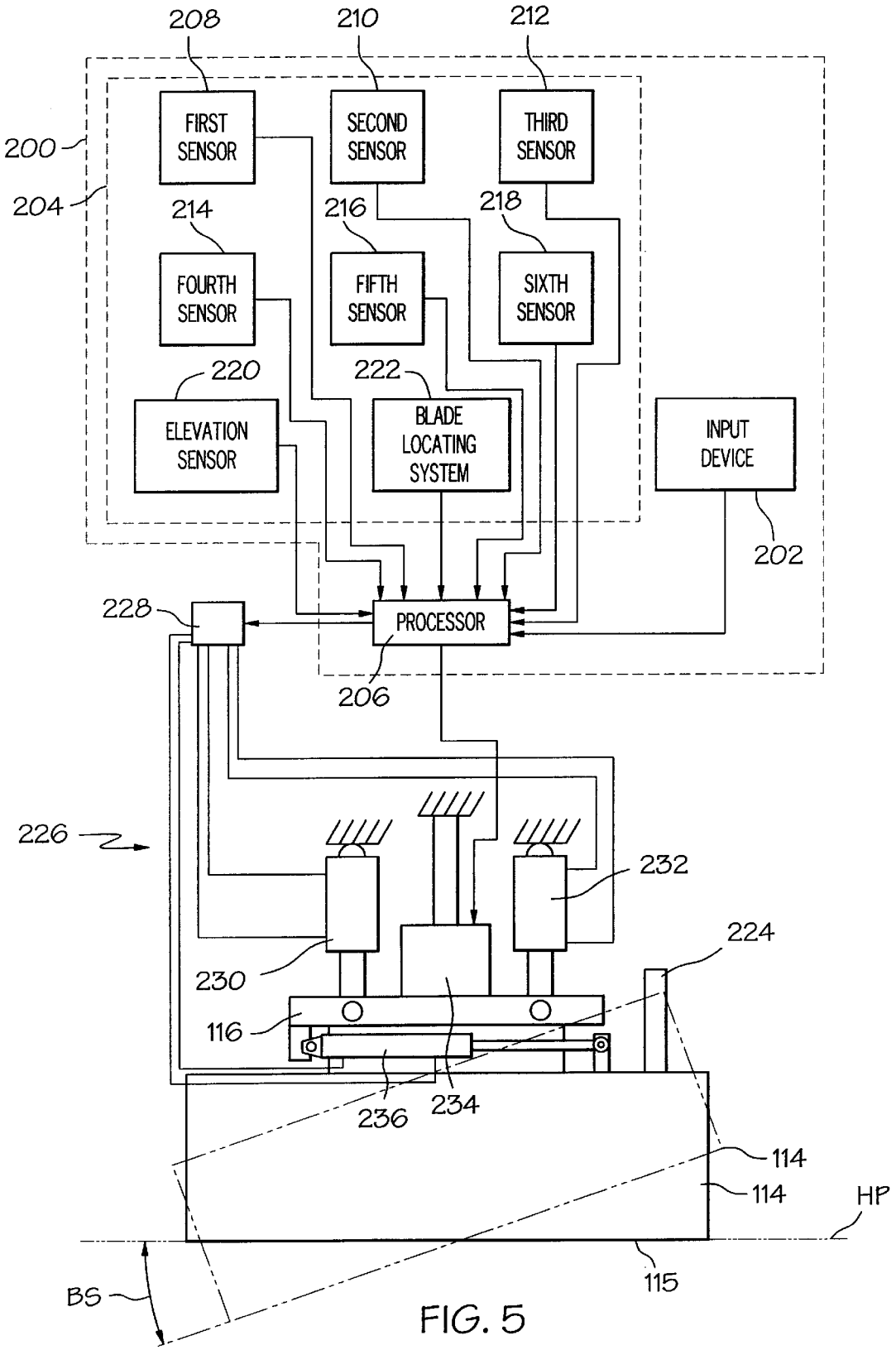
FIG. 5 is a schematic block diagram of a control system for controlling the spatial orientation of the blade of the articulated frame motorgrader of FIG. 1.

Reference is now made to the drawing figures wherein FIGS. 1–4 schematically illustrate a two-part articulated frame motorgrader 100 in plan view. The motorgrader 100 includes a rear drive unit 102 including rear drive wheels 104 and a front steering unit or main frame 106 including front steering wheels 108. The main frame 106 is connected to the rear drive unit 102 by a frame articulation joint 110 so that the main frame 106 can be rotated relative to the rear drive unit 102 to permit "crabbed" steering of the motorgrader 100, as shown in FIG. 2, and to assist the steering wheels 108 in steering the motorgrader 100 through a turn, as shown in FIGS. 3 and 4. While straight frame operations as shown in FIG. 1 is used much of the time, it is often desirable to operate the motorgrader 100, as shown in FIG. 2, with the steering unit 106 rotated at a selectable angle E relative to the rear drive unit 102, but traveling in a direction 112, 122, which is referred to as crabbed steering. It is also desirable to operate the motorgrader 100 while turning, as shown in FIGS. 3 and 4, such as when forming a cloverleaf for an exit ramp.

Referring now to FIGS. 1–5, an earthmoving blade 114 having a cutting edge 115 is supported upon the main frame 106 by a draw bar/turntable arrangement commonly referred to as a "ring" or "circle" 116 so that the blade 114 can be rotated about a generally vertical rotation axis (not shown) collinear with the center of the circle 116. The circle 116 is coupled to the main frame 106 by way of a blade frame, an A-frame 109 in the illustrated embodiment, which may be side-shifted by an operator to the left or right of a center position, as shown in FIG. 4. The blade 114 is shown in FIGS. 1 and 2 moving in a direction of travel vector 122 which may be parallel to the direction of travel vector 112 of the motorgrader 100. The direction of travel vector 122 of the blade 114, however, may not always be parallel to the direction of travel of the motorgrader 100. For example, as shown in FIGS. 3 and 4, the direction of travel vector 122 of the blade 114 varies from the direction of travel vector 112 of the motorgrader 100 when the motorgrader 100 is executing a turn. It should be apparent that the direction of travel vector 112 of the motorgrader 100 in FIGS. 3 and 4 is actually an instantaneous tangential direction of travel of the motorgrader 100 with point Z representing the instantaneous center of rotation of the motorgrader 100.

In accordance with the present invention, a method and apparatus are provided to control the cross-slope, i.e. the slope perpendicular to the direction of travel of the motorgrader 100, of the cut being made by the motorgrader 100 and the blade 114. The method and apparatus maintains the cross-slope whether the motorgrader 100 is traveling straight, executing a turn, the front wheels 108 are side-tilted, the A-frame 109 is side-shifted, or when the motorgrader 100 is operated in the crabbed steering position. As shown schematically in FIG. 5, a control system 200 is provided for controlling the spatial orientation of the blade 114 so that the desired cross-slope is cut into the surface of the earth being worked by the motorgrader 100 and the blade 114. The control system 200 comprises an input circuit 202, a sensor system 204 and a computer processor 206. The processor 206 is electrically coupled to the input circuit 202 and the sensor system 204 so as to receive output signals generated from the same. The input circuit 202 comprises a keyboard or the like, for selecting a desired shape of the surface of earth to be worked. In the illustrated embodiment, the operator will select a desired cross-slope angle CS by inputting the same into the input circuit 202. The input circuit 202 generates an output signal indicative of the desired cross-slope angle CS and transmits the same to the processor 206. In the illustrated embodiment, the input device 202 is positioned within the cab (not shown) of the motorgrader 100 so as to be easily accessible to the operator. However, it will be appreciated by those skilled in the art that the input device 202 may be positioned in any appropriate location. It will be further appreciated by those skilled in the art that the input device 202 may connected to the control system 200 as needed, and disconnected once the desired shape or cross-slope of the surface being worked is programmed in the processor 206.

The sensor system 204 determines some or all of the directional changes of the blade 114 and motorgrader 100, particularly the main frame 106 on which the blade 114 is mounted, so that a required blade slope angle BS for the blade 114 may be calculated for the desired cross-slope angle CS. In the illustrated embodiment, the sensor system 204 includes a first sensor 208, a second sensor 210, a third sensor 212, a fourth sensor 214, a fifth sensor 216, a sixth sensor 218, an elevation sensor 220 and a blade locating system 222.

The first sensor 208 is coupled to the frame 106 and generates a first signal indicative of the pitch or longitudinal slope M of the frame 106 with respect to the horizontal plane. By measuring the longitudinal slope M of the frame 106, the pitch of the terrain over which the motorgrader 100 is operating is determined. Any changes in the uphill or down hill slope of the terrain is transferred to the motorgrader 100 such that the motorgrader 100 itself is used to measure the slope of the ground upon which it is sitting. In other words, by measuring the longitudinal slope M of the motorgrader 100, and specifically, the frame 106, the longitudinal slope of the ground is determined.

The first sensor 208 detects the longitudinal slope M or changes in the longitudinal slope either directly or indirectly. One type of sensor which can detect such directional changes directly is a gravity sensor. A number of different gravity sensors may be used, such as a slope sensor, an inclinometer, an accelerometer and a pendulum sensor. A gravity sensor is particularly useful for stable machines, such as a motorgrader which has a long wheel base.

Another type of sensor which can detect directional changes directly is a gyroscope, preferably, a single axis gyroscope. The output signals from a gyroscope coupled to either the blade 114 or the frame 106 represent actual changes in the longitudinal slope M of the frame 106 without further processing by the processor 206. A gyroscope is particularly useful for measuring the longitudinal slope of less stable machines with shorter wheel bases, such as a bulldozer, as it has a faster response time than a gravity sensor. One type of sensor which can detect directional changes indirectly is a rate sensor. A rate sensor detects rotational velocity changes which are converted into angular changes by integrating. The signals from a rate sensor represent the rotational velocity changes of the frame 106 and must be integrated by the processor 114 so as to determine the slope changes. A rate sensor in combination with a gravity sensor may be used to measure the longitudinal slope of a less stable machine as it can provide the necessary response required for control of such machines. There are a number of different rate sensors which may be used, such as a ring laser or a piezoelectric rate sensor. Whatever sensor is used, the first sensor 208 determines the longitudinal slope of the ground by measuring the longitudinal slope of the frame 106.

The second sensor 210 is coupled to the frame 106 and generates a second signal indicative of an azimuth or turn angle B between the frame 106 and the direction of travel vector 122 of the blade 114. When executing a turn, the direction of the travel vector 122 of the blade 114 does not correspond to the direction of travel of the frame 106, i.e., the direction of travel vector 122 of the blade 114 is not in line with the frame 106. Accordingly, measurement of the longitudinal slope M by the first sensor 208 must be compensated for by the turn angle B of the frame 106 and roll angle or existing cross-slope of the terrain. The turn angle B of the direction of travel vector 122 of the blade 114 is measured relative to a centerline axis 124 of the frame 106. The second sensor 210 comprises either a gyroscope, a rate sensor or a heading sensor. The gyroscope or rate sensor is configured to generate an accurate rotational (azimuth) measurement anytime the motorgrader 100 executes a turn. It should be apparent when the motorgrader 100 is traveling straight, the direction of travel vector 112 of the frame 106 is aligned with the direction of travel vector 122 of the blade 114. A heading sensor may comprise an electronic or magnetic compass that indicates a heading vector of the frame 106. The heading sensor is thus also configured to generate an accurate rotational measurement anytime the motorgrader 100 executes a turn. A heading sensor may also be configured to indicate pitch and roll readings. The second sensor 210 is reinitialized whenever a null point flag or zero marker indicator is tripped indicating that the sensor 210 should be reading zero. The operator reinitializes the second sensor 210 as necessary when the motorgrader 100 is traveling generally straight.

In most fine grading applications, the roll angle of the motorgrader 100 is assumed to be the existing cross-slope of the terrain over which the motorgrader 100 is traveling. The roll angle is commonly referred to as the lateral slope angle L of the frame 106. If the motorgrader is not performing fine grading, the exact angle is therefore somewhat irrelevant. However, depending on the particular application, such as a tight clover leaf or cul-de-sac application, where the turn angle B is relatively large, the lateral slope angle L is measured by the fifth sensor 216. The fifth sensor 216 is coupled to frame and generates a fifth signal indicative of the lateral slope L of the frame 106 with respect to horizontal. The fifth sensor 216 comprises a gravity sensor, such as a slope sensor, an inclinometer, an accelerometer or a pendulum sensor. Accordingly, the longitudinal slope M is accurately determined by compensating for the lateral slope L of the frame 106 and the turn angle B of the frame 106, when the motorgrader 100 is executing a turn.

The orientation of the blade 114 also affects the cross-slope cutting capabilities of the motorgrader 100. The pitch, azimuth and roll of the blade 114 are considered. The pitch, i.e., the forward or backward angle, of the blade 114 has no bearing on the angular measurements described herein. The pitch of the blade 114 only effects the actual elevation of the blade such that a direct measurement of the pitch is not required.

The azimuth of the blade 114 is affected by a rotation angle Θ of the blade 114 and the side-shift angle σ of the A-frame 109. The third sensor 212 is coupled to the blade 114 and generates a signal indicative of the rotation angle Θ of the blade 114. In the illustrated embodiment, the third sensor 212 is coupled to the blade 114, and specifically, to the hydraulic swivel joint 126 about which the circle 116 and the blade 114 rotates. The third sensor 212 comprises an encoder or a resistive potentiometer to measure the rotation angle Θ directly from the swivel joint 126. The third sensor 212 is configured so that the rotation angle Θ is measured with respect to an axis 128 perpendicular to an axis 130 of the A-frame 109. As shown in FIGS. 1–3, the axis 130 coincides with the mainframe 106 and the centerline axis 124, while in FIG. 4, the axis 130 is offset from the mainframe 106 and the centerline axis 124 by the side-shift angle σ. It will be appreciated by those skilled in the art that the rotation angle Θ may be measured with respect to any appropriate axis or reference line.

The fourth sensor 214 is configured to generate a fourth signal indicative of the side-shift angle σ of the blade 114 with respect to the frame 106. As shown in FIG. 4, the side-shift angle σ corresponds to the angle between the centerline axis 124 and the axis 130 of the A-frame 109. The fourth sensor 214 comprises either a gyroscope, a rate sensor or a heading sensor. As with the other gyroscopes and rate sensors described herein, the operator can reinitialize the sensor whenever a null-point or zero marker flag is tripped. The azimuth of the blade 114 is calculated based on the rotation angle Θ and the side-shift angle σ.

The roll of the blade 114 corresponds to the blade slope BS of the blade 114. The sixth sensor 218 is coupled to the blade 114 and generates a sixth signal indicative of the blade slope angle BS of the blade 114. The sixth sensor 218 provides feedback to ensure the actual blade slope angle BS of the blade 114 corresponds to the calculated blade slope angle BS. The sixth sensor 218 comprises a gravity sensor, such as a slope sensor, an inclinometer, an accelerometer or a pendulum sensor. Such gravity sensors generally respond quickly enough so that the blade 114 may be moved smoothly based on differences between the calculated blade slope angle BS and the measured blade slope angle BS. The sixth sensor 218 may also comprise a gyroscope or a rate sensor.

The elevation sensor 220 determines a vertical position of the blade 114, particularly, the cutting edge 115 of the blade 114. In the illustrated embodiment, the elevation sensor 220 comprises a laser control system (not shown). A laser control system includes a laser transmitter (not shown) which transmits a rotating beam of laser light which defines a reference plane. The laser transmitter is positioned at a known location on the worksite. A laser detector (not shown) is positioned on the motorgrader 100. The laser beam from the laser transmitter sweeps across the laser detector. A signal is transmitted from the laser detector to the processor 206 indicating a relative position of the laser beam on the detector. The processor 206 is programmed to determine the relative elevation of the blade 114 based on the signal from the laser detector, and thus, the relative vertical position of the blade 114 relative to the surface of the earth being worked by the blade 114. It will be appreciated by those skilled in the art that the elevation sensor 220 may comprise other appropriate elevation sensors, such as a sonic tracer or a laser tracer, the functions of both being well known in the art. The elevation sensor 220 is used to sense the height of the blade 114 from the reference surface so that the blade is properly positioned at the desired elevation on the work site.

The blade locating system 222 provides an indication of the location of the blade 114 on the work site. In the illustrated embodiment, the blade locating system 222 comprises a Global Positioning System (GPS). The GPS includes a GPS antenna 224 mounted on the blade 114 and a receiver unit (not shown). The antenna 224 receives reference signals from GPS satellites orbiting the earth. These signals are processed by the receiver unit and a signal representative of the position of the blade 114 on the worksite is transmitted to the processor 206. An absolute position of the blade 114 is thus established by the processor 206 in response to the signals from the receiver unit. It will be appreciated by those skilled in the art that other blade locating systems may be used to determine the location of the blade 114 on the worksite. The desired path of the motorgrader 100 may be programmed into the processor 206. The blade locating system 222 monitors the actual path of the motorgrader 100, and hence, the blade 114, with the processor 206 determining whether the operator has deviated from the desired path. The processor 206 then controls the blade 114 so that the blade 114 is cutting the desired cross-slope relative to the desired path as opposed to the actual path.

The processor 206 is arranged to receive the signals from the input device 202 as well as each of the sensors in the sensor system 204. The processor 206 is programmed to control the spatial orientation of the blade 114 in response to those signals. The processor 206 is arranged and programmed to control a blade actuating mechanism 226. The blade actuating mechanism 226 is coupled to the circle 116 and controls the spatial orientation of the blade 114. The blade actuating mechanism 226 includes a flow valve 228, a first cylinder 230, a second cylinder 232 and a rotating device 234. The cylinders 230 and 232 are hydraulic cylinders and well known in the art. The processor 206 controls the flow valve 228 which in turns controls the cylinders 230 and 232. The processor 206 is thus able to control the elevation and roll of the blade 114 by controlling the flow valve 228. The processor 206 is also configured to monitor the rotating device 234. The rotating device 234 is arranged to control the circle rotation angle Θ or orientation of the blade 114 with respect to the axis 128. The circle rotation angle Θ may be any desired angle depending on the circumstances. The circle rotation angle Θ is set by the operator and transmitted to the processor 206 by the third sensor 212.

The processor 206 can also be programmed to control the blade's line of travel by controlling the side shift position of the blade 114. The side shift position of the blade 114 is set by the operator and transmitted to the processor 206 by the blade location system 222. The desired path of the motorgrader 100 is also programmed into the processor 206. The processor 206 controls the flow valve 228 which in turn controls a side shift cylinder 236. The processor 206 is thus able to control the blade's line of travel by matching the blade;s actual side shift position with the desired path. It will be appreciated by those skilled in the art that the side shift position may be set manually without any control by the processor 206 or the blade location system 222.

Once the circle rotation angle Θ and the side-shift angle σ are set, the azimuth of the blade 114 is controlled by the processor 206 with any changes in the circle rotation or side-shift, either by the operator or by the operation of the motorgrader 100, being referenced back to the respective axes as set forth above. The pitch of the blade 114 is monitored by the elevation sensor 220 and compensated for by the processor 206. The roll of the blade 114 which affects the cross-slope cut by the blade 114 is controlled by the processor 206 via the blade actuating mechanism and monitored by the sixth sensor 218. Accordingly, the spatial orientation of the blade 114 is controlled by the processor 206 in response to the signals from the sensor system 204 and the input device 202. As described above, the blade locating system 222 and the processor are configured to ensure that the spatial orientation of the blade 114 corresponds to the desired path of the motorgrader 100 as opposed to the actual path in case the operator deviates from the desired path.

Figure 6:
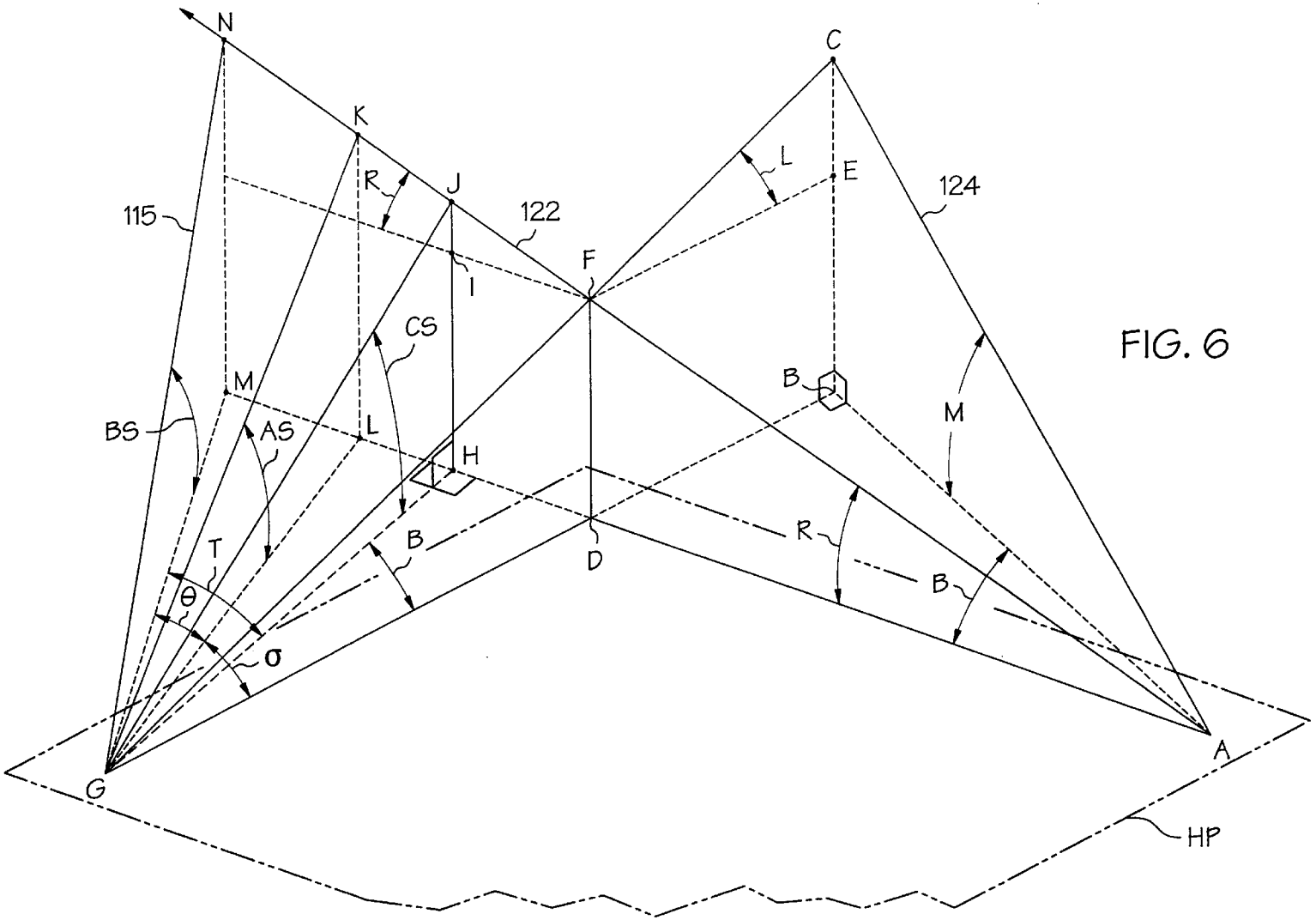
FIG. 6 is a line drawing illustrating relative orientations of components of the articulated motorgrader of FIG. 1 used to derive equations for controlling the spatial orientation of the blade.

Equations will now to be developed for the operation of the processor 206 so as to control the spatial orientation of the blade 114 such that the desired cross-slope is cut into the earth being worked by the blade 114. Referring now to FIG. 6 which is a vector diagram for a clover leaf type application, the following angular orientations and references are monitored or controlled by the processor 206, the input device 202 and the sensor system 204: CS is the desired cross-slope angle as selected by the operator using the input device 202; BS is the required blade slope angle of the blade 114 relative to the horizontal plane HP and measured by the sixth sensor 218; M is the longitudinal slope of the frame 106 relative to the horizontal plane HP and measured by the first sensor 208; B is the turn angle of the frame 106 relative to the direction of travel of the blade 114 and measured by the second sensor 210; Θ is the rotational angle of the blade 114 measured by the third sensor 212; σ is the side-shift angle of the blade 114 measured by the fourth sensor 214; and L is the lateral slope angle of the frame 106 measured by the fifth sensor 216. It will be appreciated by those skilled in the art that the following equations are valid for other applications, such as a cul-de-sac application.

FIG. 6 also illustrates: the horizontal plane HP; an imaginary point A on the cutting edge 115 of the blade 114 at a particular time; vector AC representing the frame 106 and specifically the centerline axis 124; vector AB representing the centerline axis 124 projected in the horizontal plane HP; a direction vector AF, AJ, AK, AN representing the direction of travel vector 122 of the blade 114; a vector AD representing the direction of travel vector 122 of the blade 115 projected in the horizontal plane HP; angle R representing the angle between the direction of travel of the blade 114 and the horizontal plane HP which corresponds to the resultant mainfall slope of the frame 106 or the earth being work; point G corresponding to an imaginary point on the cutting edge 115 of the blade 114 at another particular time; line GN representing the cutting edge 115 of the blade 114; vector GD representing a perpendicular line of frame 106; vector GK showing the slope angle AS of the A-frame 109 relative to the horizontal plane HP; vector GL representing the horizontal component of the vector GK and serving as a reference vector for the rotational angle Θ and the side-shift angle σ; angle T representing the rotational angle of the blade 114 relative to the direction of travel vector 122 of the blade 114; a vector GJ showing the cross-slope angle CS; vector GH perpendicular to the direction of travel vector AF representing the horizontal component of the vector GJ for the cross-slope angle CS and serving as a reference vector for the turn angle B and the rotational angle T; a vector FE parallel to the horizontal plane HP and perpendicular to the vector AB; and a vector CF showing the lateral slope angle L.

A first equation (A) will now be derived which allows the processor 206 to determine the required blade slope angle BS of the blade 114 so that the surface of the earth being worked by the blade 114 has the desired cross-slope angle CS. This equation provides the proper blade slope angle BS for the blade 114 when the motorgrader 100 is operated in a straight frame mode, is being steered through a turn, is operated in a crabbed steering position, the circle 116 is rotated, the blade 114 is side-shifted, or any combination of the above. Additionally, this equation provides the proper blade slope angle BS even if the motorgrader 100 is operated in a steep slope condition. By making reference to FIG. 6, the following derivation of equation (A) should be apparent:

$$\tan(BS) = \frac{MN}{GM} \tag{1}$$

$$GM=\sqrt{\sqrt{MH^2+GH^2}} \tag{2}$$

$$MH=GH\cdot\tan(T) \tag{3}$$

$$\tan(R) = \frac{MN - HJ}{MH} \tag{4}$$

$$MN=MH\cdot\tan(R)+HJ \tag{5}$$

$$HJ=GH\cdot\tan(CS) \tag{6}$$

Substituting equations 2 and 5 into equation 1 yields:

$$\tan(BS) = \frac{MH\cdot\tan(R) + HJ}{\sqrt{MH^2 + GH^2}} \tag{7}$$

Substituting equations 3 and 6 into equation 7 yields:

$$\tan(BS) = \frac{GH\cdot\tan(T)\cdot\tan(R) + GH\cdot\tan(CS)}{\sqrt{(GH\cdot\tan(T))^2 + GH^2}} \tag{8}$$

$$\tan(BS) = \frac{GH(\tan(T)\cdot\tan(R) + \tan(CS))}{GH\sqrt{\tan(T)^2 + 1}} \tag{9}$$

$$\tan(BS) = \frac{(\tan(T)\cdot\tan(R) + \tan(CS))}{\sqrt{\tan(T)^2 + 1}} \tag{10}$$

$$\cos(T) = \frac{1}{\sqrt{\tan(T)^2 + 1}} \tag{11}$$

Substituting equation 11 into equation 10 yields:

$$\tan(BS)=\cos(T)\cdot\tan(T)\cdot\tan(R)+\cos(T)\cdot\tan(CS) \tag{12}$$

$$\tan(BS)=\sin(T)\cdot\tan(R)+\cos(T)\cdot\tan(CS) \tag{A}$$

where BS is the required blade slope angle of the blade 114 relative to the horizontal plane HP; T is the rotational angle of the blade 114 with respect to the blade's direction of travel vector 122 projected into the horizontal plane HP; R is the resultant mainfall slope which is the angle between the direction of travel vector 122 of the blade 114 and the horizontal plane HP; and CS is the desired cross-slope angle as selected by the operator.

As shown in FIG. 6, rotational angle T is equal to angle Θ+angle σ−angle B, wherein angle Θ is the rotational angle of the blade 114 projected into the horizontal plane HP and measured by the third sensor 212; angle σ is the side-shift angle of the blade 114 with respect to the frame 106 projected into the horizontal plane HP and measured by the fourth sensor 214; and angle B is the turn angle between the frame 106 and the direction of travel vector 122 of the blade 114 projected into the horizontal plane HP. It should thus be apparent that the required blade slope angle BS to cut the desired cross-slope angle is directly related to the rotational angle Θ, the side-shift angle σ and the turn angle B. Accordingly, if the blade 114 is not side-shifted or rotated and the motorgrader 100 is not executing a turn, the required blade slope angle BS will equal the desired cross-slope angle CS as expected.

It should be apparent that in those applications in which the blade 114 is not rotated or side-shifted or is not capable of being rotated or side-shifted, the rotational angle T is equal to the negative of the turn angle B. Accordingly, equation (A) becomes:

$$\tan(BS)=\sin(-B)\cdot\tan(R)+\cos(-B)\cdot\tan(CS) \quad (A)'$$

which equals:

$$\tan(BS)=\tan(CS)\cdot\cos(B)-\tan(R)\cdot\sin(B) \quad (A)'$$

A second equation (B) will now be derived which allows the processor 206 to determine the resultant mainframe slope R during a turn or the angle between the direction of travel vector 122 of the blade 114 and the horizontal plane HP and which is used in conjunction with equation (A) to determine the required blade slope angle BS:

$$\tan(R)=\frac{DF}{AD} \quad (13)$$

$$BC=AB\cdot\tan(M) \quad (14)$$

$$DF=BE \quad (15)$$

$$BC=BE+CE \quad (16)$$

Substituting equation 15 into equation 16 yields:

$$BC=DF+CE \quad (17)$$

Substituting equation (14) into equation (17) yields:

$$DF=AB\cdot\tan(M)-CE \quad (18)$$

$$CE=EF\cdot\tan(L) \quad (19)$$

Substituting equation (19) into equation (18) yields:

$$DF=AB\cdot\tan(M)-EF\cdot\tan(L) \quad (20)$$

$$BD=AB\cdot\tan(B) \quad (21)$$

$$EF=BD \quad (22)$$

Substituting equation (22) into equation (21) yields:

$$EF=AB\cdot\tan(B) \quad (23)$$

Substituting equation (23) into equation (20) yields:

$$DF=AB\cdot\tan(M)-AB\cdot\tan(B)\cdot\tan(L) \quad (24)$$

$$DF=AB\cdot(\tan(M)-\tan(B)\cdot\tan(L)) \quad (25)$$

Substituting equation (25) into equation (13) yields:

$$\tan(R)=\frac{AB\cdot(\tan(M)-\tan(B)\cdot\tan(L))}{AD} \quad (26)$$

$$\cos(B)=\frac{AB}{AD} \quad (27)$$

Substituting equation (27) into equation (26) yields:

$$\tan(R)=\cos(B)\cdot(\tan(M-\tan(B)\cdot\tan(L)) \quad (28)$$

$$\tan(B)=\frac{\sin(B)}{\cos(B)} \quad (29)$$

Substituting equation (29) into equation (28) and solving yields:

$$\tan(R)=\cos(B)\cdot\tan(M)-\sin(B)\cdot\tan(L) \quad (B)$$

where R is the resultant mainfall slope angle and the angle between the direction of travel vector 122 of the blade 114 and the horizontal plane HP; M is the longitudinal slope angle of the frame 106 with respect to the horizontal plane HP as measured by the first sensor 208; B is the turn angle of the frame 106 with respect to the blade's direction of travel vector 122 projected into the horizontal plane (HP); and L is the lateral slope angle of the frame 106 with respect to the horizontal plane HP as measured by the fifth sensor 216. It should be apparent from FIG. 6 that in those circumstances where the turn angle B is relatively small, the lateral slope angle L may be assumed to equal the desired cross-slope angle CS as the vector GH is drawn towards vector GD. The angles B, L and M have a positive value in the cloverleaf application illustrated in FIG. 6. It will be appreciated by those skilled in the art that in other applications, one or more of angles B, L and M may have a negative value. However, even if one or more of angles B, L and M have a negative value, equation (B) is still valid.

Equations (A) and (B) enable the processor 206 to control the spatial orientation of the blade 114 based in part from the measurements from the first, second, third, fourth, and fifth sensors 208, 210, 212, 214, 216. Equations (A) and (B) require. at least a measurement of the turn angle B from the second sensor 210 and the longitudinal slope angle M from the first sensor 208. The turn angle B is measured relative to the frame 106 such that the frame 106 serves as the frame of reference for the measurement. The side-shift angle σ and the rotation angle Θ need to be measured only when the blade 114 is side-shifted or rotated. Accordingly, in those situations where the blade 114 is neither side-shifted nor rotated or when the control system 200 is used on earth-moving equipment where the blade 14 cannot be side-shifted or rotated, the third and fourth sensors 212, 214 are unnecessary. Additionally, for complete accuracy the lateral slope angle L needs to be measured. However, in applications with relatively small turns, the lateral slope L may be assumed to equal the desired cross-slope CS. The control system 200 of the present is able to accurately calculate the required blade slope angle BS necessary for cutting the desired cross-slope angle CS when the earthmoving machine upon which it is used is executing a turn, the blade 114 is rotated, the blade 114 is side-shifted, or the machine is articulated. It should be apparent that the articulation angle of the motorgrader 100 does not have to be measured as it is measured indirectly by the second sensor 210.

Having described the invention in detail and by reference to preferred embodiments thereof, it will be apparent that modifications and variations are possible without departing from the scope of the invention defined in the appended claims.

What is claimed is:

1. A control system for controlling the spatial orientation of an earthmoving blade mounted on a frame of an earthmoving machine and adjustably moveable by a blade actuating mechanism in order to control the working of a surface of earth to a desired shape, said control system comprising:

an input circuit arranged to generate an output signal representative of the desired shape of the surface of earth to be worked;

a sensor system comprising:

a first sensor generating a first signal indicative of a longitudinal slope angle of said frame with respect to horizontal;

a fourth sensor generating a fourth signal indicative of a side-shift angle of said blade with respect to said frame; and a processor electrically coupled to said input circuit and said sensor system and programmed to control said spatial orientation of said blade by controlling the activation of said blade actuating mechanism in response to at least said output signal from said input circuit, at least said first signal from said first sensor and at least said fourth signal from said fourth sensor.

2. The control system of claim 1, wherein said first sensor comprises a gravity sensor.

3. The control system of claim 2, wherein said gravity sensor is selected from the group consisting of a slope sensor, an inclinometer, an accelerometer and a pendulum sensor.

4. The control system of claim 1, wherein said first sensor comprises a gyroscope.

5. The control system of claim 2, wherein said first sensor further comprises a rate sensor.

6. The control system of claim 5, wherein said rate sensor is selected from the group consisting of a piezoelectric rate sensor and a ring laser.

7. The control system of claim 1, wherein said fourth sensor is selected from the group consisting of a gyroscope, a rate sensor and a heading sensor.

8. The control system of claim 1, wherein said sensor system further comprises a third sensor generating a third signal indicative of a rotational angle of said blade, and wherein said processor is programmed to control said spatial orientation of said blade by controlling the activation of said blade actuating mechanism in response to at least said output signal from said input circuit, at least said first signal from said first sensor, at least said fourth signal from said fourth sensor and at least said third signal from said third sensor.

9. The control system of claim 1, wherein said third sensor is configured to generate said third signal indicative of said rotational angle of said blade with respect to an axis perpendicular to a blade frame supporting said blade.

10. The control system of claim 1, wherein said sensor system further comprises a second sensor generating a second signal indicative of a turn angle between said frame and a direction of travel of said blade, and wherein said processor is programmed to control said spatial orientation of said blade by controlling the activation of said blade actuating mechanism in response to at least said output signal from said input circuit, at least said first signal from said first sensor, at least said second signal from said second sensor and at least said fourth signal from said fourth sensor.

11. The control system of claim 1, wherein said sensor system further comprises a fifth sensor generating a fifth signal indicative of a lateral slope angle of said frame with respect to horizontal, and wherein said processor is programmed to control said spatial orientation of said blade by controlling the activation of said blade actuating mechanism in response to at least said output signal from said input circuit, at least said first signal from said first sensor, at least said fourth signal from said fourth sensor and at least said fifth signal from said fifth sensor.

12. The control system of claim 1, wherein said sensor system further comprises an elevation sensor arranged to determine a vertical position of said blade relative to the surface of earth being worked.

13. The control system of claim 1, wherein said sensor system further comprises a blade locating system for identifying a location of said blade on a work site.

14. The control system of claim 13, wherein said blade locating system comprises a Global Positioning System (GPS) with at least one GPS antenna mounted on said blade for identifying the location of said blade on said work site.

15. The control system of claim 11, wherein said fifth sensor is a gravity sensor selected from the group consisting of a slope sensor, an inclinometer, an accelerometer and a pendulum sensor.

16. The control system of claim 1, wherein said sensor system further comprises a sixth sensor coupled to said blade generating a sixth signal indicative of said blade slope of said blade with respect to horizontal and wherein said processor is programmed to control said spatial orientation of said blade by controlling the activation of said blade actuating mechanism in response to at least said output signal from said input circuit, at least said first signal from said first sensor, at least said fourth signal from said fourth sensor and at least said sixth signal from said sixth sensor.

17. A control system for controlling the spatial orientation of an earthmoving blade mounted on a frame of an earthmoving machine and adjustably moveable by a blade actuating mechanism in order to control the working of a surface of earth to a desired shape, said control system comprising:

an input circuit arranged to generate an output signal representative of the desired shape of the surface of earth to be worked;

a sensor system comprising:

a first sensor generating a first signal indicative of a longitudinal slope angle of said frame with respect to horizontal;

a second sensor generating a second signal indicative of a turn angle between said frame and a direction of travel of said blade;

a third sensor generating a third signal indicative of a rotational angle of said blade; and a fourth sensor generating a fourth signal indicative of a side-shift angle of said blade with respect to said frame; and a processor electrically coupled to said input circuit and said sensor system and programmed to control said spatial orientation of said blade by controlling the activation of said blade actuating mechanism in response to at least said output signal from said input circuit, at least said first signal from said first sensor, at least said second signal from said second sensor, at least said third signal from said third sensor and at least said fourth signal from said fourth sensor.

18. The control system of claim 17, wherein said sensor system further comprises a fifth sensor generating a fifth signal indicative of a lateral slope angle of said frame with respect to horizontal, and wherein said processor is programmed to control said spatial orientation of said blade by controlling the activation of said blade actuating mechanism in response to at least said output signal from said input circuit, at least said first signal from said first sensor, at least said second signal from said second sensor, at least said third signal from said third sensor, at least said fourth signal from said fourth sensor and at least said fifth signal from said fifth sensor.

19. The control system of claim 17, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(T)+\tan(R)\cdot\sin(T);$$

$$\tan(R)=\tan(M)\cdot\cos(B)-\tan(CS)\cdot\sin(B);\text{ and}$$

$$T=\Theta+\sigma-B$$

where:

BS is the blade slope angle of said blade relative to horizontal;

CS is said desired cross-slope angle of said surface;

T is the rotational angle of said blade relative to said direction of travel of said blade;

R is an angle between said direction of travel of said blade and horizontal;

M is said longitudinal slope angle of said frame with respect to horizontal;

Θ is said rotational angle of said blade;

σ is said side-shift angle of said blade with respect to said frame; and

B is said turn angle between said frame and said direction of travel of said blade.

20. The control system of claim 18, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(T)+\tan(R)\cdot\sin(T);$$

$$\tan(R)=\tan(M)\cdot\cos(B)-\tan(L)\cdot\sin(B);\text{ and}$$

$$T=\Theta+\sigma-B$$

where:

BS is the blade slope angle of said blade relative to horizontal;

CS is said desired cross-slope angle of said surface;

T is the rotational angle of said blade relative to said direction of travel of said blade;

R is an angle between said direction of travel of said blade and horizontal;

M is said longitudinal slope angle of said frame with respect to horizontal;

Θ is said rotational angle of said blade;

σ is said side-shift angle of said blade with respect to said frame;

B is said turn angle between said frame and said direction of travel of said blade; and L is said lateral slope angle of said frame with respect to horizontal.

21. The control system of claim 17, wherein said first sensor comprises a gravity sensor.

22. The control system of claim 21, wherein said gravity sensor is selected from the group consisting of a slope sensor, an inclinometer, an accelerometer and a pendulum sensor.

23. The control system of claim 17, wherein said first sensor comprises a gyroscope.

24. The control system of claim 17, wherein said second sensor is selected from the group consisting of a gyroscope, a rate sensor and a heading sensor.

25. The control system of claim 17, wherein said third sensor is selected from the group consisting of an encoder and a resistive potentiometer.

26. The control system of claim 17, wherein said fourth sensor is selected from the group consisting of a gyroscope, a rate sensor and a heading sensor.

27. The control system of claim 18, wherein said fifth sensor is a gravity sensor selected from the group consisting of a slope sensor, an inclinometer, an accelerometer and a pendulum sensor.

28. The control system of claim 17, wherein said third sensor is configured to generate said third signal indicative of said rotational angle of said blade with respect to an axis perpendicular to a blade frame supporting said blade.

29. The control system of claim 19, wherein said sensor further comprises a sixth sensor coupled to said blade generating a sixth signal indicative of said blade slope of said blade with respect to horizontal.

30. An earthmoving machine comprising:

a vehicle having a frame;

an earthmoving blade coupled to said frame and adjustably moveable with respect to said frame by a blade actuating mechanism; and a control system arranged to control a spatial orientation of said blade in order to control the working of a surface of earth to a desired shape, said control system comprising:

an input circuit arranged to generate an output signal representative of the desired shape of the surface of earth to be worked;

a sensor system comprising:

a first sensor generating a first signal indicative of a longitudinal slope angle of said frame with respect to horizontal; and a second sensor genera ting a second signal indicative of a turn angle between said frame and a direction of travel of said blade;

a fifth sensor generating a fifth signal indicative of a lateral slope angle of said frame with respect to horizontal; and a processor electrically coupled to said input circuit and said sensor system and programmed to control said spatial orientation of said blade by controlling the activation of said blade actuating mechanism in response to at least said output signal from said input circuit, at least said first signal from said first sensor and at least said second signal from said second sensor, and at least said fifth signal from said fifth sensor.

31. The earthmoving machine of claim 30, further comprising a blade frame coupled to said frame of said vehicle with said blade being coupled to said blade frame, and wherein said sensor system further comprises a third sensor to generate a third signal indicative of a rotational angle of said blade, and wherein said processor is programmed to control said spatial orientation of said blade by controlling the activation of said blade actuating mechanism in response to at least said output signal from said input circuit, at least said first signal from said first sensor, at least said second signal from said second sensor, and at least said fifth signal from said fifth sensor, and at least said third signal from said third sensor.

32. The earthmoving machine of claim 31, wherein said sensor system further comprises a fourth sensor generating a fourth signal indicative of a side-shift angle of said blade with respect to said frame, and wherein said processor is programmed to control said spatial orientation of said blade by controlling the activation of said blade actuating mechanism in response to at least said output signal from said input circuit, at least said first signal from said first sensor, at least said second signal from said second sensor, at least said third signal from said third sensor and at least said fourth signal from said fourth sensor, and at least said fifth signal from said fifth sensor.

33. The earthmoving machine of claim 30, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(B)-\tan(R)\cdot\sin(B);\text{ and}$$

$$\tan(R)=\tan(M)\cdot\cos(B)-\tan(CS)\cdot\sin(B)$$

where:

BS is the blade slope angle of said blade relative to horizontal;

CS is said desired cross-slope angle of said surface;

B is said turn angle between said frame and said direction of travel of said blade;

R is an angle between said direction of travel of said blade and horizontal; and M is said longitudinal slope angle of said frame with respect to horizontal.

34. The earthmoving machine of claim 30, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(B)-\tan(R)\cdot\sin(B);\text{ and}$$

$$\tan(R)=\tan(M)\cdot\cos(B)-\tan(L)\cdot\sin(B)$$

where:

BS is the blade slope angle of said blade relative to horizontal;

CS is said desired cross-slope angle of said surface;

B is said turn angle between said frame and said direction of travel of said blade;

R is an angle between said direction of travel of said blade and horizontal;

M is said longitudinal slope angle of said frame with respect to horizontal; and L is said lateral slope angle of said frame with respect to horizontal.

35. The earthmoving machine of claim 32, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(T)+\tan(R)\cdot\sin(T);$$

$$\tan(R)=\tan(M)\cdot\cos(B)-\tan(CS)\cdot\sin(B);\text{ and}$$

$$T=\Theta+\sigma-B$$

where:

BS is the blade slope angle of said blade relative to horizontal;

CS is said desired cross-slope angle of said surface;

T is the rotational angle of said blade relative to said direction of travel of said blade;

R is an angle between said direction of travel of said blade and horizontal;

M is said longitudinal slope angle of said frame with respect to horizontal;

$\Theta$ is said rotational angle of said blade;

$\sigma$ is said side-shift angle of said blade with respect to said frame; and

B is said turn angle between said frame and said direction of travel of said blade.

36. The earthmoving machine of claim 32, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(T)+\tan(R)\cdot\sin(T);$$

$$\tan(R)=\tan(M)\cdot\cos(B)-\tan(L)\cdot\sin(B);\text{ and}$$

$$T=\Theta+\sigma-B$$

where:

BS is the blade slope angle of said blade relative to horizontal;

CS is said desired cross-slope angle of said surface;

T is the rotational angle of said blade relative to said direction of travel of said blade;

R is an angle between said direction of travel of said blade and horizontal;

M is said longitudinal slope angle of said frame with respect to horizontal;

$\Theta$ is said rotational angle of said blade;

$\sigma$ is said side-shift angle of said blade with respect to said frame;

B is said turn angle between said frame and said direction of travel of said blade; and L is said lateral slope angle of said frame with respect to horizontal.

37. The earthmoving machine of claim 30, wherein said first sensor comprises a gravity sensor.

38. The earthmoving machine of claim 37, wherein said gravity sensor is selected from the group consisting of a slope sensor, an inclinometer, an accelerometer and a pendulum sensor.

39. The earthmoving machine of claim 30, wherein said first sensor comprises a gyroscope.

40. The earthmoving machine of claim 30, wherein said second sensor is selected from the group consisting of a gyroscope, a rate sensor and a heading sensor.

41. The earthmoving machine of claim 31, wherein said third sensor is selected from the group consisting of an encoder and a resistive potentiometer.

42. The earthmoving machine of claim 32, wherein said fourth sensor is selected from the group consisting of a gyroscope, a rate sensor and a heading sensor.

43. The earthmoving machine of claim 30, wherein said fifth sensor is a gravity sensor selected from the group consisting of a slope sensor, an inclinometer, an accelerometer and a pendulum sensor.

44. The earthmoving machine of claim 30, wherein said sensor system further comprises an elevation sensor arranged to determine a vertical position of said blade relative to the surface of earth being worked.

45. The earthmoving machine of claim 30, wherein said sensor system further comprises a blade locating system for identifying a location of said blade on a work site.

46. The earthmoving machine of claim 45, wherein said blade locating system comprises a Global Positioning System (GPS) with at least one GPS antenna mounted on said blade for identifying the location of said blade on said work site.

47. The earthmoving machine of claim 31, wherein said third sensor is configured to generate said third signal indicative of said rotational angle of said blade relative to an axis perpendicular to an axis of said blade frame.

48. The earthmoving machine of claim 30, wherein said vehicle comprises a bulldozer.

49. The earthmoving machine of claim 30, wherein said vehicle comprises a motorgrader.

50. The earthmoving machine of claim 30, wherein said sensor further comprises a sixth sensor coupled to said blade generating a sixth signal indicative of said blade slope of said blade with respect to horizontal and wherein said processor is programmed to control said spatial orientation of said blade by controlling the activation of said blade actuating mechanism in response to at least said output signal from said input circuit, at least said first signal from said first sensor, at least said second signal from said second sensor, at least said fifth signal from said fifth sensor, and at least said sixth signal from said sixth sensor.

51. A method of working a surface of earth to a desired shape, said method comprising the steps of:

providing a frame coupled to an adjustably moveable earthmoving blade for working said surface of earth to said desired shape;

working said surface of earth to the desired shape with said earthmoving blade;

detecting a change in a longitudinal slope of said frame with respect to horizontal as said earthmoving blade works said surface of earth;

detecting a change in a side-shift angle of said blade relative to said frame; and controlling a spatial orientation of said earthmoving blade so as to control the working of said surface of earth to the desired shape, at least in part, in response to said detected changes in said longitudinal slope and said side-shift angle.

52. The method of claim 51, wherein said earthmoving blade is supported by a blade frame coupled to said frame, and further comprising the step of detecting a change in a rotational angle of said blade with respect to an axis perpendicular to said blade frame as said earthmoving blade works said surface of earth, and wherein said step of controlling a spatial orientation of said earthmoving blade so as to control the working of said surface of earth to the desired shape, at least in part, in response to said detected changes in said longitudinal slope and said side-shift angle comprises the step of controlling a spatial orientation of said earthmoving blade so as to control the working of said surface of earth to the desired shape, at least in part, in response to said detected changes in said longitudinal slope of said frame, said side-shift angle and said rotational angle of blade.

53. The method of claim 52, further comprising the step of detecting a change in a turn angle between said frame and a direction of travel of said earthmoving blade as said earthmoving blade works said surface of earth, and wherein said step of controlling a spatial orientation of said earthmoving blade so as to control the working of said surface of earth to the desired shape, at least in part, in response to said detected changes in said longitudinal slope and said turn angle comprises the step of controlling a spatial orientation of said earthmoving blade so as to control the working of said surface of earth to the desired shape, at least in part, in response to said detected changes in said longitudinal slope of said frame, said turn angle, said rotational angle of blade and said side-shift angle of blade.

54. The method of claim 53, further comprising the step of detecting a change in a lateral slope angle of frame relative to horizontal, and wherein said step of controlling a spatial orientation of said earthmoving blade so as to control the working of said surface of earth to the desired shape, at least in part, in response to said detected changes in said longitudinal slope and said turn angle comprises the step of controlling a spatial orientation of said earthmoving blade so as to control the working of said surface of earth to the desired shape, at least in part, in response to said detected changes in said longitudinal slope of said frame, said turn angle, said rotational angle of blade, said side-shift angle of blade and said lateral slope angle of frame.

55. The method of claim 51, further comprising the step of detecting a change in a turn angle between said frame and a direction of travel of said earthmoving blade as said earthmoving blade works said surface of earth, and wherein said step of controlling a spatial orientation of said earthmoving blade so as to control the working of said surface of earth to the desired shape, at least in part, in response to said detected changes in said longitudinal slope and said turn angle comprises the step of controlling a spatial orientation of said earthmoving blade so as to control the working of said surface of earth to the desired shape, at least in part, in response to said detected changes in said longitudinal slope of said frame, said turn angle and said side-shift angle of blade.

56. The method of claim 51, further comprising the step of detecting a change in a lateral slope angle of frame relative to horizontal, and wherein said step of controlling a spatial orientation of said earthmoving blade so as to control the working of said surface of earth to the desired shape, at least in part, in response to said detected changes in said longitudinal slope and said side-shift angle comprises the step of controlling a spatial orientation of said earthmoving blade so as to control the working of said surface of earth to the desired shape, at least in part, in response to said detected changes in said longitudinal slope of said frame, said side-shift angle and said lateral slope angle of frame.

57. The method of claim 51, further comprising the step of locating a vertical position of said earthmoving blade relative to said surface of earth being worked.

58. The method of claim 51, further comprising the step of identifying a location of said earthmoving blade on a work site containing said surface of earth being worked.

59. The method of claim 51, further comprising the step of selecting a desired cross-slope angle of said surface of earth to be worked.

60. The method of claim 55, wherein said step of controlling a spatial orientation of said earthmoving blade so as to control the working of said surface of earth to the desired shape, at least in part, in response to said detected changes in said longitudinal slope and said turn angle is for controlling the working of said surface of earth to a desired cross-slope angle, and said method includes the step of calculating a blade slope angle used to obtain said desired cross-slope angle of said surface according to the equations:

$$\tan(BS)=\tan(CS)\cdot\cos(B)-\tan(R)\cdot\sin(B);\text{ and}$$

$$\tan(R)=\tan(M)\cdot\cos(B)-\tan(CS)\cdot\sin(B)$$

where:

BS is the blade slope angle of said blade relative to horizontal;

CS is said desired cross-slope angle of said surface;

B is said turn angle between said frame and said direction of travel of said blade;

R is an angle between said direction of travel of said blade and horizontal; and M is said longitudinal slope angle of said frame with respect to horizontal.

61. The method of claim 53, wherein said step of controlling a spatial orientation of said earthmoving blade so as to control the working of said surface of earth to the desired shape, at least in part, in response to said detected changes in said longitudinal slope, said turn angle, said rotational angle and said side-shift angle is for controlling the working of said surface of earth to a desired cross-slope angle, and said method includes the step of calculating a blade slope angle used to obtain said de sired cross-slope angle of said surface according to the equations:

$$\tan(BS)=\tan(CS)\cdot\cos(T)+\tan(R)\cdot\sin(T);$$

$$\tan(R)=\tan(M)\cdot\cos(B)-\tan(CS)\cdot\sin(B);\text{ and}$$

$$T=\Theta+\sigma-B$$

where:

BS is the blade slope angle of said blade relative to horizontal;

CS is said desired cross-slope angle of said surface;

T is the rotational angle of said blade relative to said direction of travel of said blade;

R is an angle between said direction of travel of said blade and horizontal;

M is said longitudinal slope angle of said frame with respect to horizontal;

Θ is said rotational angle of said blade;

σ is said side-shift angle of said blade with respect to said frame; and

B is said turn angle between said frame and said direction of travel of said blade.

62. The method of claim 54, wherein said step of controlling a spatial orientation of said earthmoving blade so as to control the working of said surface of earth to the desired shape, at least in part, in response to said detected changes in said longitudinal slope, said turn angle, said rotational angle, said side-shift angle and said lateral slope is for controlling the working of said surface of earth to a desired cross-slope angle, and said method includes the step of calculating a blade slope angle used to obtain said desired cross-slope angle of said surface according to the equations:

$$\tan(BS)=\tan(CS)\cdot\cos(T)+\tan(R)\cdot\sin(T);$$

$$\tan(R)=\tan(M)\cdot\cos(B)-\tan(L)\cdot\sin(B);\text{ and}$$

$$T=\Theta+\sigma-$$

where:

BS is the blade slope angle of said blade relative to horizontal;

CS is said desired cross-slope angle of said surface;

T is the rotational angle of said blade relative to said direction of travel of said blade;

R is an angle between said direction of travel of said blade and horizontal;

M is said longitudinal slope angle of said frame with respect to horizontal;

Θ is said rotational angle of said blade;

σ is said side-shift angle of said blade with respect to said frame;

B is said turn angle between said frame and said direction of travel of said blade; and L is said lateral slope angle of said frame with respect to horizontal.

63. The method of claim 54, wherein said step of controlling a spatial orientation of said earthmoving blade so as to control the working of said surface of earth to the desired shape, at least in part, in response to said detected in said longitudinal slope, said turn angle, and said lateral slope is for controlling the working of said surface of earth to a desired cross-slope angle, and said method includes the step of calculating a blade slope angle used to obtain said desired cross-slope angle of said surface according to the equations:

$$\tan(BS)=\tan(CS)\cdot\cos(B)-\tan(R)\cdot\sin(B);\text{ and}$$

$$\tan(R)=\tan(M)\cdot\cos(B)-\tan(L)\cdot\sin(B)$$

where:

BS is the blade slope angle of said blade relative to horizontal;

CS is said desired cross-slope angle of said surface;

B is said turn angle between said frame and said direction of travel of said blade;

R is an angle between said direction of travel of said blade and horizontal;

M is said longitudinal slope angle of said frame with respect to horizontal; and L is said lateral slope angle of said frame with respect to horizontal.

64. A control system for controlling the spatial orientation of an earthmoving blade mounted on a frame of an earthmoving machine and adjustably moveable by a blade actuating mechanism in order to control the working of a surface of earth to a desired shape, said control system comprising:

an input circuit arranged to generate an output signal representative of the desired shape of the surface of earth to be worked;

a sensor system comprising:

a first sensor generating a first signal indicative of a longitudinal slope angle of said frame with respect to horizontal;

a second sensor generating a second signal indicative of a turn angle between said frame and a direction of travel of said blade; and a processor electrically coupled to said input circuit and said sensor system and programmed to control said spatial orientation of said blade by controlling the activation of said blade actuating mechanism in response to at least said output signal from said input circuit, at least said first signal from said first sensor and at least said second signal from said second sensor, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(B)-\tan(R)\cdot\sin(B);\text{ and}$$

$$\tan(R)=\tan(M)\cdot\cos(B)-\tan(CS)\cdot\sin(B)$$

where:

BS is the blade slope angle of said blade relative to horizontal;

CS is said desired cross-slope angle of said surface;

B is said turn angle between said frame and said direction of travel of said blade;

R is an angle between said direction of travel of said blade and horizontal; and M is said longitudinal slope angle of said frame with respect to horizontal.

65. A control system for controlling the spatial orientation of an earthmoving blade mounted on a frame of an earthmoving machine and adjustably moveable by a blade actuating mechanism in order to control the working of a surface of earth to a desired shape, said control system comprising:

an input circuit arranged to generate an output signal representative of the desired shape of the surface of earth to be worked;

a sensor system comprising:

a first sensor generating a first signal indicative of a longitudinal slope angle of said frame with respect to horizontal;

a second sensor generating a second signal indicative of a turn angle between said frame and a direction of travel of said blade;

a fifth sensor generating a fifth signal indicative of a lateral slope angle of said frame with respect to horizontal; and a processor electrically coupled to said input circuit and said sensor system and programmed to control said spatial orientation of said blade by controlling the activation of said blade actuating mechanism in response to at least said output signal from said input circuit, at least said first signal from said first sensor, at least said second signal from said second sensor and at least said fifth signal from said fifth sensor.

66. The control system of claim 65, wherein said input circuit is used to select a desired cross-slope angle of the surface of earth to be worked by said blade, said control system controlling said spatial orientation of said earthmoving blade to obtain the desired cross-slope angle of said surface as said surface is being worked, and said processor being further programmed to calculate a blade slope angle used to obtain said desired cross-slope angle of said surface according to the equations:

$$\tan(BS)=\tan(CS)\cdot\cos(B)-\tan(R)\cdot\sin(B);\text{ and}$$

$$\tan(R)=\tan(M)\cdot\cos(B)-\tan(L)\cdot\sin(B)$$

where:

BS is the blade slope angle of said blade relative to horizontal;

CS is said de sired cross-slope angle of said surface;

B is said turn angle between said frame and said direction of travel of said blade;

R is an angle between said direction of travel of said blade and horizontal;

M is said longitudinal slope angle of said frame with respect to horizontal, and L is said lateral slope angle of said frame with respect to horizontal.

* * * * *

(Also Form PTO-1050)

UNITED STATES PATENT AND TRADEMARK OFFICE

CERTIFICATE OF CORRECTION

PATENT NO : 6,112,145

DATED : August 29, 2000

INVENTOR(S) : Mark Eugene Zachman

It is certified that error appears in the above-identified patent and that said Letters Patent are hereby corrected as shown below:

| | |
|---|---|
| Claim 30, Column 22, Line 52, | "genera ting" should read --generating-- |
| Claim 61, Column 27, Line 49, | "de sired" should read --desired-- |
| Claim 62, Column 28, Line 21, | "T = Θ + σ" should read --T = Θ + σ- B-- |
| Claim 66, Column 30, Line 41, | "de sired" should read --desired-- |

Signed and Sealed this

Eighth Day of May, 2001

*Attest:*

Nicholas P. Godici

NICHOLAS P. GODICI

*Attesting Officer*

*Acting Director of the United States Patent and Trademark Office*